US008636336B2

(12) United States Patent
Goto

(10) Patent No.: US 8,636,336 B2
(45) Date of Patent: Jan. 28, 2014

(54) LIQUID DISCHARGE HEAD

(75) Inventor: Akira Goto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 148 days.

(21) Appl. No.: 13/414,064

(22) Filed: Mar. 7, 2012

(65) Prior Publication Data

US 2012/0229554 A1 Sep. 13, 2012

(30) Foreign Application Priority Data

Mar. 10, 2011 (JP) ..... 2011-052979

(51) Int. Cl.
*B41J 2/015* (2006.01)

(52) U.S. Cl.
USPC ..... 347/20

(58) Field of Classification Search
USPC ..... 347/20, 40, 44, 47
See application file for complete search history.

(56) References Cited

U.S. PATENT DOCUMENTS

2005/0157056 A1* 7/2005 Silverbrook et al. ..... 347/42
2009/0109264 A1* 4/2009 Kubo ..... 347/71

FOREIGN PATENT DOCUMENTS

JP 10-000776 A 1/1998
JP 4338202 B2 10/2009

* cited by examiner

*Primary Examiner* — Laura Martin
(74) *Attorney, Agent, or Firm* — Canon USA Inc IP Division

(57) ABSTRACT

A liquid discharge head includes a recording element substrate having a discharge-port surface having a discharge port discharging a liquid, side surfaces on sides of the discharge-port surface, and a back surface of the discharge-port surface having an opening of an ink supplying port supplying ink to the discharge port; a supporting member having a depression accommodating the recording element substrate, the depression including a supporting part disposed at a bottom surface of the depression and supporting the recording element substrate with an adhesive and an opening of an ink channel communicating with the ink supplying port; and an electric wiring substrate disposed on a surface of the supporting member having the depression and having an electric connecting part connecting with a side of the discharge-port surface of the recording element substrate.

5 Claims, 8 Drawing Sheets

LIQUID DISCHARGE HEAD

BACKGROUND OF THE INVENTION

1. Field of the Invention

The present invention relates to a liquid discharge head mounted in a recording device that carries out recording by discharging liquid, such as ink.

2. Description of the Related Art

A liquid-discharge type recording device, such as an inkjet printer, is a so-called no-impact recording device and carries out high-speed recording on various different recording media while generating almost no noise during recording. Thus, the recording device is used in a wide range of apparatuses, such as printers, word processors, facsimiles, and copiers.

Japanese Patent No. 4338202 describes an example of such a liquid discharge head. The liquid discharge head includes a recording element substrate, an electric wiring substrate, and an ink tank. The recording element substrate has an electric thermal conversion member, which is a thermal resistor. The ink is heated by the electric thermal conversion member and is discharged as ink droplets as a result of film boiling. Driving signals, etc. from the main body of the device are applied to the recording element substrate via the electric wiring substrate. The ink tank for supplying ink is disposed on the recording element substrate and includes a negative-pressure generating mechanism that retains the ink and generates negative pressure. The ink tank has a guide and a positional reference, which are used when installing the liquid discharge head on the main body of the device.

Such a liquid discharge head is produced, for example, in the following process. First, the ink tank is prepared by performing injection molding of thermoplastic resin. Then, a filter made of stainless fiber that filters unwanted substances in the ink is bonded to the ink tank. Next, the electric thermal conversion member, a discharge port group, and an ink supplying port are patterned on the recording element substrate. A liquid discharge head that discharges only one color of ink, such as black, includes an ink channel, a filter, an ink supplying port, and a discharge port group. A liquid discharge head that discharges two or more colors of ink includes ink channels, filters, ink supplying ports, and discharge port groups which correspond to the different colors of ink. Then, an electric connection pad of the recording element substrate is connected to inner leads of the electric wiring substrate.

Then, a first adhesive is applied to a surface of the ink tank where the recording element substrate is bonded, and the recording element substrate is bonded at a predetermined position. Similarly, a second adhesive is applied to a surface of the ink tank where the electric wiring substrate is bonded, and the electric wiring substrate is bonded at a predetermined position. Then, a first sealant is applied with a dispenser to the periphery of recording element substrate, is allowed to sufficiently flow, and fills the gap between the recording element substrate and the ink tank. Furthermore, a high-viscosity second sealant is applied to the electric connection pad of recording element substrate and the inner leads of the electric wiring substrate. Subsequently, the adhesives and the sealants are thermally cured at once. Then, porous resin that retains the ink and generates negative pressure is placed inside each ink tank; a predetermined amount of ink of each color is injected into the corresponding ink tank; and a covering member is joined to each ink tank. Among the liquid discharge heads produced in this way, only good-quality products that have passed various inspections are selected, packaged, and shipped.

If the four sides of the recording element substrate in a liquid discharge head are sealed with a sealant, the sealant holds down the recording element substrate. Therefore, the recording element substrate may be damaged infrequently by stress applied to the recording element substrate due to a temperature or humidity cycle.

As a solution to this, Japanese Patent Laid-Open No. 10-000776 discloses a technique for bonding a recording element unit to an ink tank after sealing an electric connecting part of the recording element unit with a sealant. With this technique, the four sides of the recording element substrate do not need to be sealed with a sealant, and only the electric connecting part is sealed with a sealant. Therefore, damage to the recording element substrate due to a temperature or humidity cycle is less likely to occur.

With the technique described in Japanese Patent Laid-Open No. 10-000776, a bonding failure, such as a pinhole, at the bonding part (adhesive) bonding the recording element unit to the ink tank may lead to a defective product because ink will may leak from the bonding part where the sealant is not applied.

SUMMARY OF THE INVENTION

A liquid discharge head includes a recording element substrate having a discharge-port surface having a discharge port discharging a liquid, side surfaces on sides of the discharge-port surface, and a back surface of the discharge-port surface having an opening of an ink supplying port supplying ink to the discharge port; a supporting member having a depression accommodating the recording element substrate, the depression including a supporting part disposed at a bottom surface of the depression and supporting the recording element substrate with an adhesive and an opening of an ink channel communicating with the ink supplying port; and an electric wiring substrate disposed on a surface of the supporting member having the depression and having an electric connecting part connecting with a side of the discharge-port surface of the recording element substrate, wherein the side surfaces of the recording element substrate includes a first side surface on a side of the discharge-port surface having the electric connecting part and a second side surface on a side of the discharge-port surface not having the electric connecting part, wherein the bottom surface of the depression has a groove part extending along the second side surface between the supporting part and a sidewall of the depression, and wherein a space between the first side surface and the sidewall of the depression is sealed together with the electric connecting part with a sealant, at least a part of the second side surface is exposed and not covered with the sealant, and at least part of a surface of the adhesive facing the sidewall of the depression is sealed with the sealant.

Further features of the present invention will become apparent from the following description of exemplary embodiments with reference to the attached drawings.

DESCRIPTION OF THE EMBODIMENTS

A liquid discharge head according to the present invention can be used in typical printing devices, copiers, facsimiles having a communication system, recording devices of multifunction devices having a printing unit and an image reading mechanism, and industrial recording devices functionally combining various processing devices. The liquid discharge head according to the present invention may be fixed to a recording device or may be provided as a detachable cartridge.

First Embodiment

Figure 1:
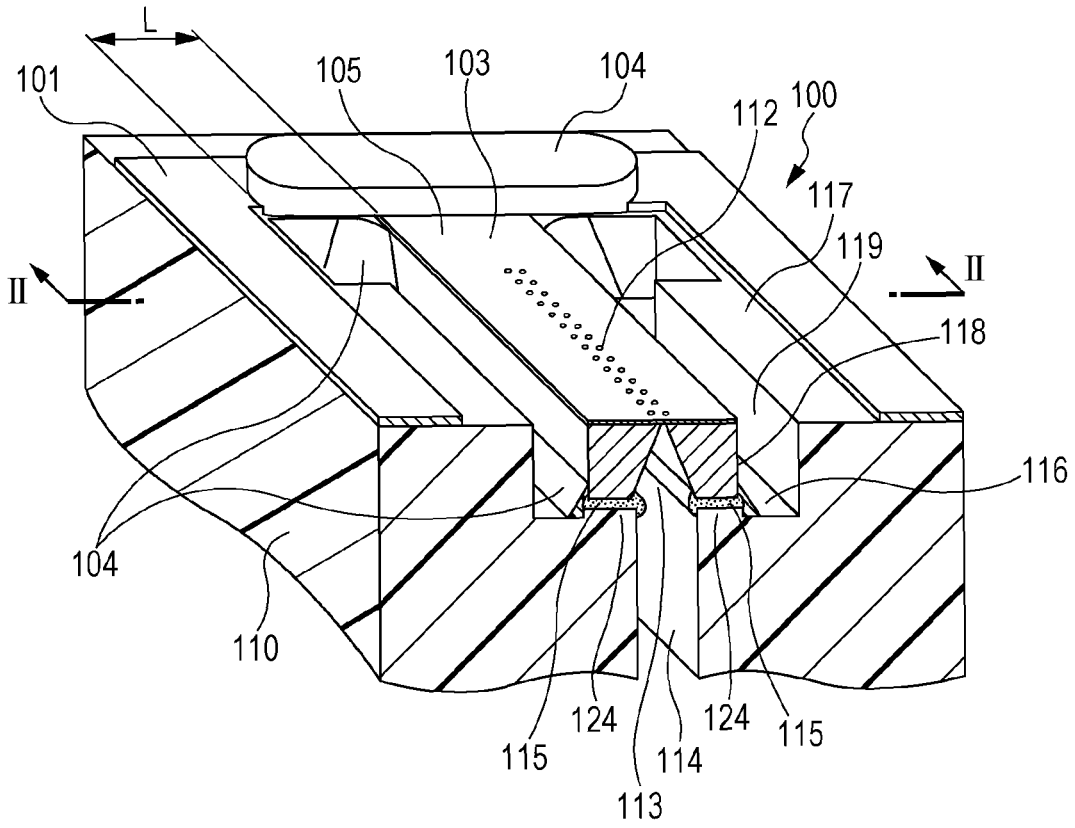
FIG. 1 is a perspective view of a liquid discharge head according to a first embodiment.
Figure 2:
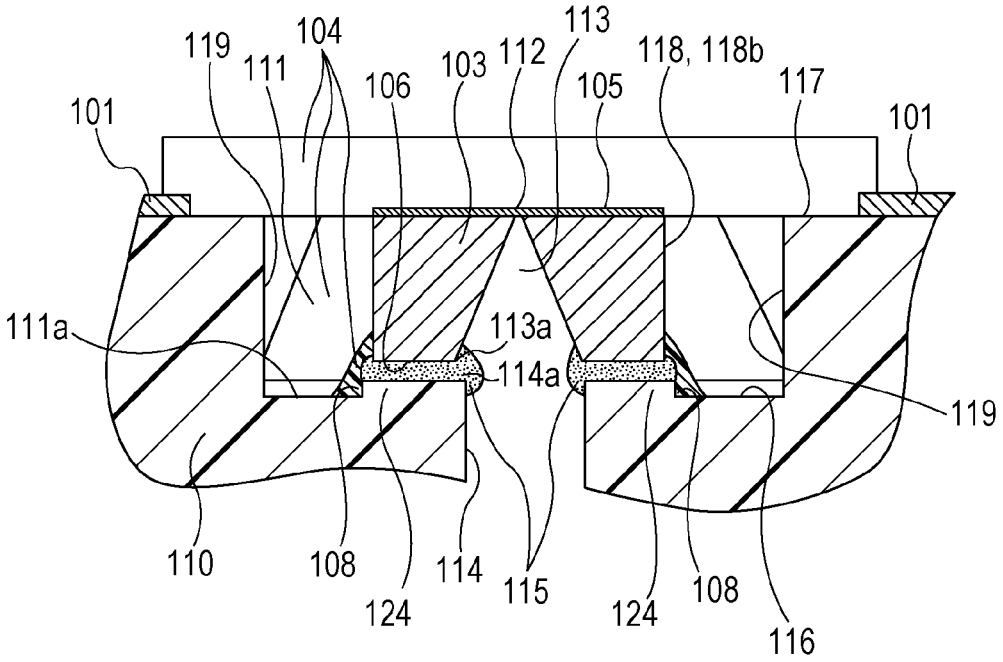
FIG. 2 is a sectional view of the liquid discharge head illustrated in FIG. 1.
Figure 3:
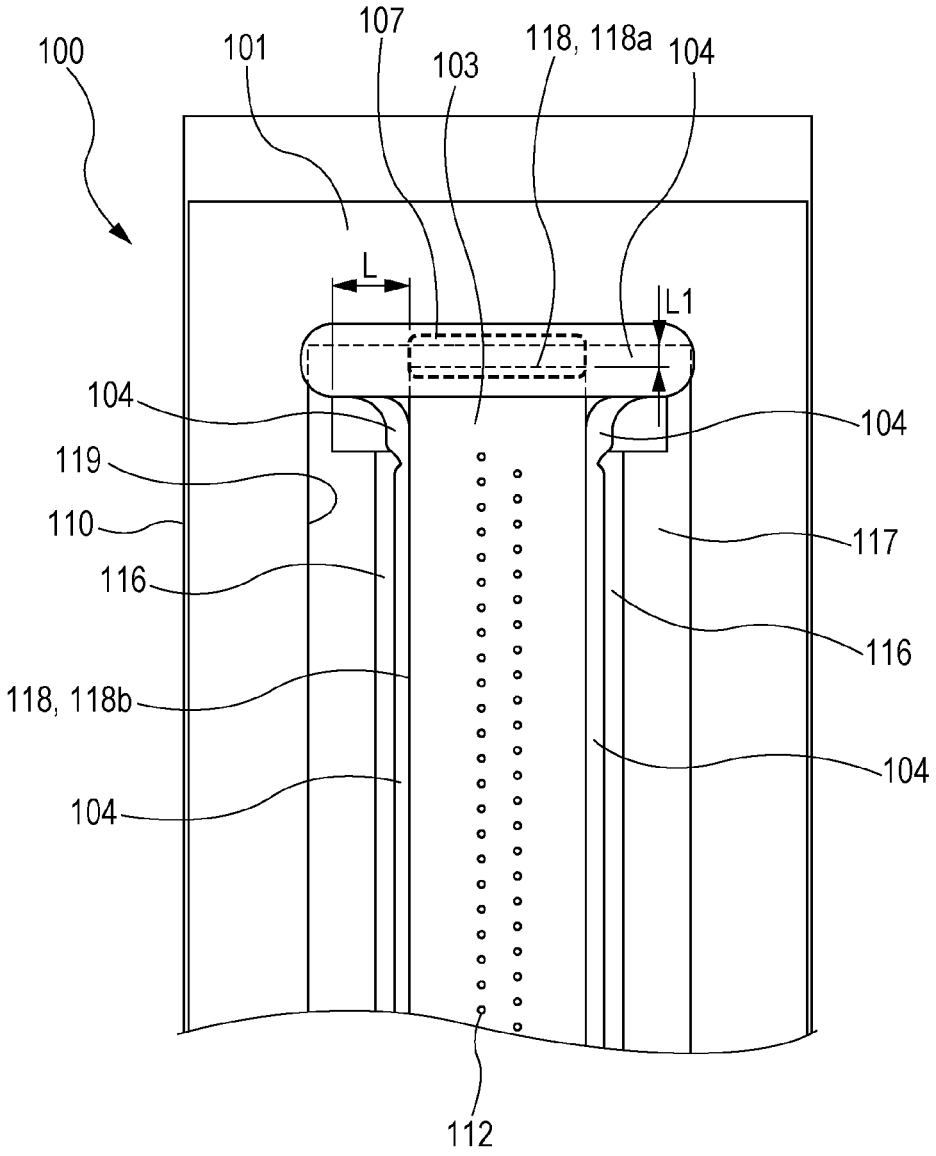
FIG. 3 is a plan view of the liquid discharge head illustrated in FIG. 1.

FIG. 1 is a perspective view of a liquid discharge head according to a first embodiment of the present invention. FIG. 2 is an enlarged sectional view taken along line II-II in FIG. 1. FIG. 3 is a plan view.

A liquid discharge head 100 includes a recording element substrate 103, an electric wiring substrate 101, and a supporting member. In the following description, the recording element substrate 103 and the electric wiring substrate 101 are bonded to the supporting member. In this embodiment, an ink tank 110 serves as the supporting member, but instead, a supporting member may be provided separately from the ink tank 110.

In this embodiment, the recording element substrate 103 includes a discharge-port member bonded to a silicon substrate. The discharge-port member is made of resin and has discharge ports from which liquid ink is discharged, and silicon substrate includes an energy generating element for generating energy used for discharging ink. The recording element substrate 103 has a discharge-port surface 105, a back surface 106 of the discharge-port surface 105, and a plurality of (four, in this embodiment) side surfaces 118 of the discharge-port surface 105. The recording element substrate 103 has a group of discharge ports, which discharging ink (hereinafter, referred to as "discharge port group 112"), multiple foaming chambers (not shown) communicating with the discharge port group 112, a common liquid chamber (not shown) communicating with the multiple foaming chambers, and an ink supplying port 113. The ink supplying port 113 supplies ink to the discharge port group 112 through the common liquid chamber. The discharge port group 112 includes openings in the discharge-port surface 105, and the ink supplying port 113 is an opening in the back surface 106. In other words, an opening 113*a* of the ink supplying port 113 is formed in the back surface 106 of the recording element substrate 103.

The recording element substrate 103 is placed in a depression 111 in the ink tank 110 with the discharge-port surface 105 facing outward. The ink is supplied to the ink supplying port 113 in the recording element substrate 103 through an ink channel 114, which is formed in the ink tank 110 and communicates with a negative-pressure generating mechanism (not shown). The recording element substrate 103 is prepared by patterning a functional inorganic film on a silicon wafer, forming the foaming chambers and nozzle with photosensitive resin on the silicon wafer, and finally, dicing the silicon wafer. Thus, the four side surfaces 118 (side surfaces of the substrate bonded with the discharge-port member) are sectional surfaces where the silicon is exposed and are substantially orthogonal with the discharge-port surface 105.

The electric wiring substrate 101 transmits driving signals and driving power to the recording element substrate 103. The electric wiring substrate 101 is fixed to the surface of the ink tank 110 having the depression 111 (hereinafter, this surface is referred to as "ink-tank surface 117") with a second adhesive (not shown). The electric wiring substrate 101 has an electric connecting part 107, which is connected to one of the sides of the discharge-port surface 105 of the recording element substrate 103. Specifically, inner leads of the electric wiring substrate 101 (not shown here but represented by reference numerals 1, 2, and 3 in FIGS. 5 and 7) and an electric connecting pad (not shown) of the recording element substrate 103, which is electrically connected to the inner leads, constitute the electric connecting part 107.

The ink tank 110 is made of thermoplastic resin having a softening temperature higher than the curing temperatures of a sealant (described below) and first and second adhesives. The bottom surface 111*a* of the depression 111 in the ink tank 110 has an opening 114*a* of the ink channel 114, which communicates with the ink supplying port 113, supporting parts 124, which extend around the opening 114*a*, and groove parts 116, which each extend between the corresponding supporting part 124 and a corresponding sidewall 119 of the depression 111. The recording element substrate 103 is bonded to and supported by the supporting parts 124 of the ink tank 110 with a first adhesive 115. The sidewalls 119 of the depression 111 in the ink tank 110 connect the height difference between the groove parts 116 and the ink-tank surface 117. It is desirable to form the groove parts 116 around the supporting parts 124 because a meniscus force due to the adhesive applied to the supporting parts 124 is generated at the boundary of the groove part 116, enabling the adhesive to be applied in thick layers.

A sealant 104 seals the electric connecting part 107 in the space between the side surface 118 of the recording element substrate 103 that has the side facing the electric connecting part 107 on the discharge-port surface 105 (hereinafter this surface is referred to as "first side surface 118*a*") and the corresponding sidewall 119 of the depression 111. The sealant 104 is made of thermal-curable resin. The side surfaces 118 of the recording element substrate 103 on the other sides of the discharge-port surface 105, i.e., on the sides of the discharge-port surface 105 not having the electric connecting part 107 (hereinafter, these surfaces are referred to as "second side surfaces 118*b*") are not covered with the sealant 104 and are exposed. At least part of the surfaces of the first adhesive 115 that is interposed between the back surface 106 of the recording element substrate 103 and the supporting parts 124 of the ink tank 110, facing the sidewalls 119 of the depression 111, is sealed with the sealant 104.

The liquid discharge head 100 according to this embodiment is produced as described below. First, the ink tank 110 is prepared by performing injection molding of thermoplastic resin. Then, a filter made of stainless fiber that filters unwanted substances in the ink is bonded to the ink tank 110. Next, an electric thermal conversion member, the discharge port group 112, and the ink supplying port 113 are patterned on the recording element substrate 103. A liquid discharge head that discharges only one color of ink, such as black, includes an ink channel, a filter, an ink supplying port, and a discharge port group. A liquid discharge head that discharges two or more colors of ink includes ink channels, filters, ink supplying ports, and discharge port groups which correspond to the different colors of ink.

Then, the first adhesive 115 is applied to the supporting parts 124 of the ink tank 110, and the recording element substrate 103 is bonded at a predetermined position. Similarly, the second adhesive is applied to the ink-tank surface 117 of the ink tank 110, and the electric wiring substrate 101 is bonded at a predetermined position. The first and second adhesives are thermal-curable resin but alternatively may be photo-curable resin.

Then, the sealant 104 is applied closed to the electric connecting part 107. In this area close to the electric connecting part 107, the width L1 of the gap between the first side surface 118*a* of the recording element substrate 103 and the opposing sidewall 119 of the depression 111 is smaller than the width L of the area where the sealant 104 is applied. Thus, the sealant 104 enters the space between the first side surface 118*a* and the opposing sidewall 119 of the depression 111 by capillary action. The space is sealed with the sealant 104, which also covers the first adhesive 115 exposed in the lower area of the first side surface 118*a*. By selecting the sealant 104 with appropriate viscosity, the electric connecting part 107 can also be sealed with the sealant 104, and satisfactory reliability can be achieved.

The sealant 104 that has entered the space between the first side surface 118*a* and the sidewall 119 of the depression 111 by capillary action is thermally cured together with the first and second adhesives. The viscosity of the sealant 104 decreases temporarily before curing, causing a small amount of the sealant 104 to flow along edge parts 108 defined by the second side surfaces 118*b* and the groove parts 116, reaching the ends, and curing. As a result, the entire length of the surface of the first adhesive 115 exposed between the back surface 106 of the recording element substrate 103 and the ink tank 110 is also covered with the sealant 104. Parts of the bottom surfaces of the groove parts 116 and parts of the second side surfaces 118*b* are not covered with the sealant 104 and are exposed. The area of the second side surfaces 118*b* covered with the sealant 104 is desirably smaller than the exposed area of the second side surfaces 118*b*.

Then, porous resin that retains the ink and generates negative pressure is placed inside the ink tank 110; a predetermined amount of ink of the each color is injected to the corresponding ink tank 110; and a covering member (not shown) is joined to the ink tank 110.

In this embodiment, only part of the groove parts 116 is filled with the sealant 104, and parts of the second side surfaces 118*b* of the recording element substrate 103 are not covered with the sealant 104. Thus, the recording element substrate 103 is less likely to be held down by the sealant 104, and the stress that is generated by a temperature or humidity cycle and applied to the recording element substrate 103 is reduced. Accordingly, damage of the recording element substrate 103 due to such stress can be reduced. In addition to damage due to a temperature or humidity cycle, damage to the recording element substrate 103 due to a mechanical external force applied to the liquid discharge head can also be reduced.

In this embodiment, since the surface of the first adhesive 115 is covered with the sealant 104, ink leakage from the ink supplying port 113 and/or the ink channel 114 is inhibited at both the first adhesive 115 and the sealant 104. Even if the first adhesive 115 has a crack and/or bonding failure, ink leakage from the ink supplying port 113 and/or the ink channel 114 is inhibited because the surface of the first adhesive 115 is covered with the sealant 104. The side surfaces 118 of the recording element substrate 103 are cutting surfaces remaining after substrates are cut out of a wafer and, thus, are prone to chipping. Usually, only small pieces are chipped off, but occasionally a large piece is chipped off, and, depending on the bonding precision of the recording element substrate 103 to the ink tank 110, a pinhole-like channel from the ink supplying port 113 or the ink channel 114 to the outside is formed. In this embodiment, such pinhole-like channels are also covered with the sealant 104 when the first adhesive 115 is covered with the sealant 104. The possibility of ink leakage is reduced, and yield is improved.

Second Embodiment

Figure 4:
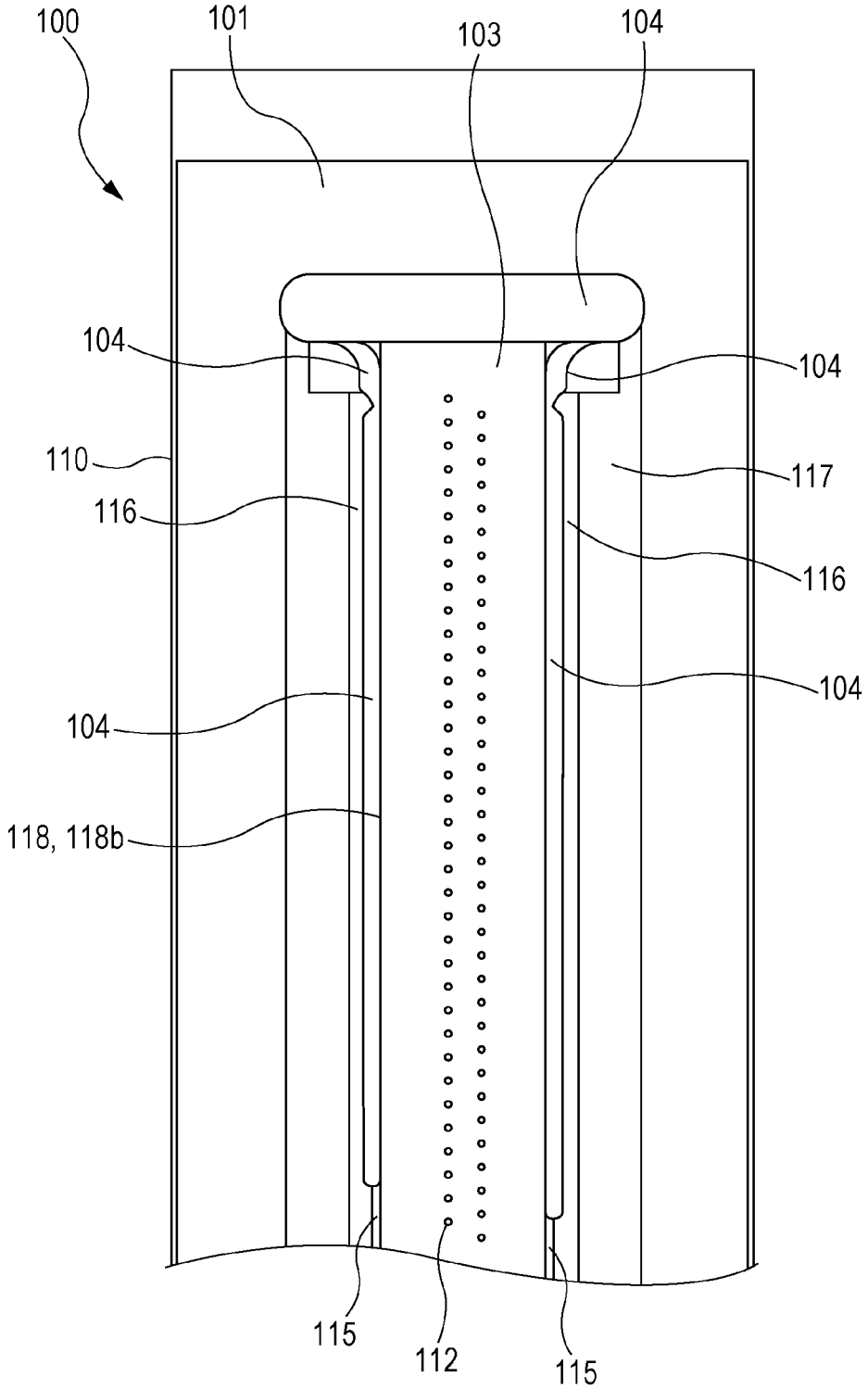
FIG. 4 is a plan view of a liquid discharge head according to a second embodiment.

Similar to FIG. 3, FIG. 4 is a plan view of a second embodiment of the present invention. Members and parts that are the same as those in FIGS. 1 to 3 are represented by the same reference numerals. The longitudinal length of the recording element substrate 103 may vary depending on ink color and/or the specification of the liquid discharge head. For example, a recording element substrate for black ink is usually longer than a recording element substrate for color ink other than black. For example, the longitudinal length of a recording element substrate for color ink may be approximately 13 mm, whereas the length of that for black ink may be approximately 20 mm. In this embodiment, the longitudinal length of the recording element substrate 103 is long, and the sealant 104 covers only part of the first adhesive 115, as illustrated in FIG. 4.

In this embodiment, parts of the second side surfaces 118*b* in the longitudinal direction are not covered with the sealant 104. Thus, compared with the first embodiment, the force of the sealant 104 holding down the recording element substrate 103 is reduced even more. Hence, stress generated in a temperature or humidity cycle and applied to the recording element substrate 103 is reduced even more, and damage to the recording element substrate 103 due to such stress can easily be reduced. The same advantages as those in the first embodiment can be achieved for ink leakage prevention at the parts covered with the sealant 104. That is, ink leakage from the ink supplying port 113 or the ink channel 114 is suppressed by both the first adhesive 115 and the sealant 104. Even if the adhesive has a crack and/or bonding failure, the sealant 104 reduces leakage. Ink leakage due to chipping can also be reduced, and yield is improved even more.

Third Embodiment

Figure 5:
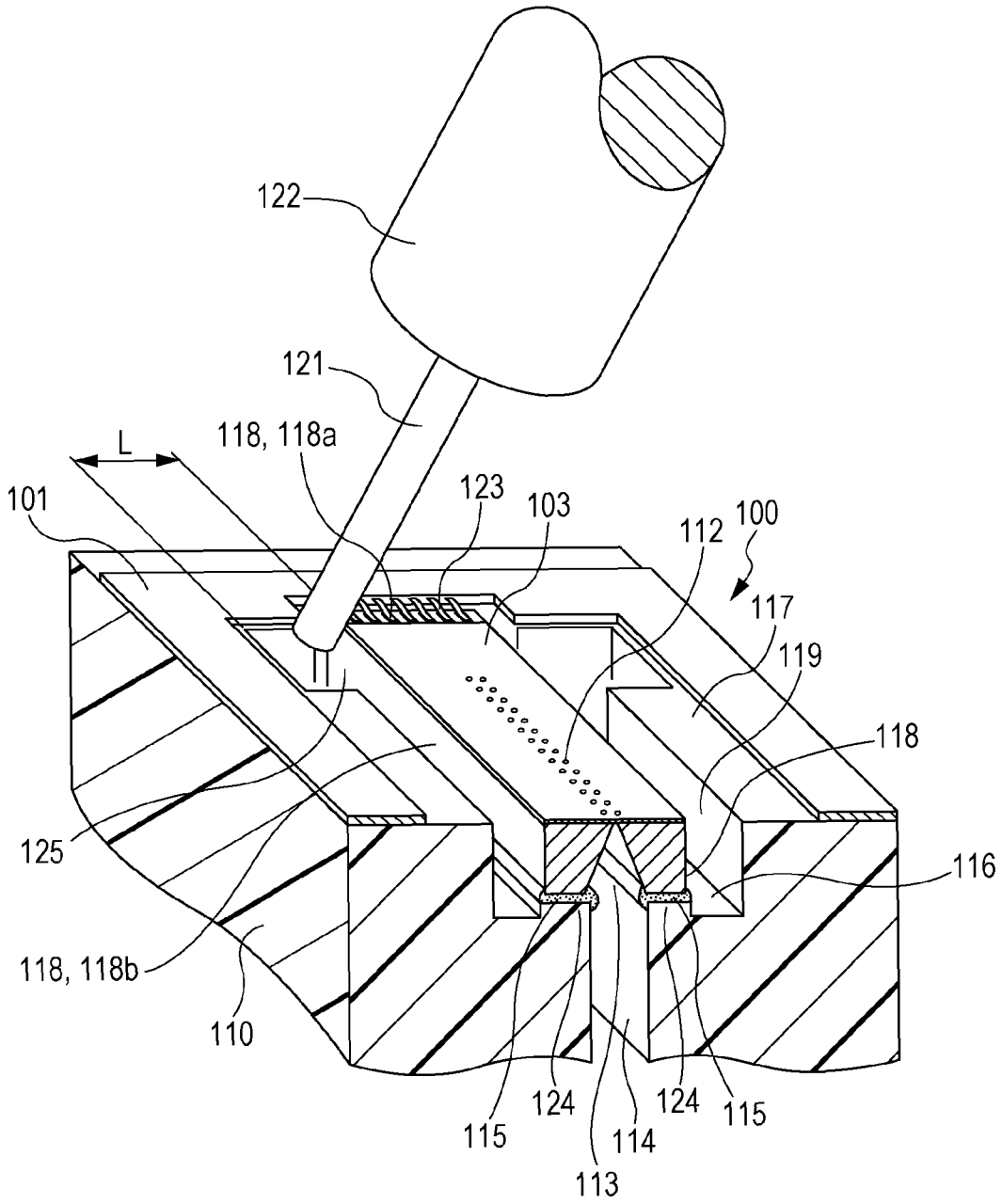
FIG. 5 is illustrates a method of producing a liquid discharge head according to a third embodiment.

Similar to FIG. 1, FIG. 5 is a perspective view of a third embodiment of the present invention. Members and parts that are the same as those in FIGS. 1 to 4 are represented by the same reference numerals. Except for the method of forming a sealant, the basic configuration and method of producing the liquid discharge head are the same as those according to the first embodiment. The method of producing a liquid discharge head according to this embodiment will be described below.

Similar to the first embodiment, the recording element substrate 103, the electric wiring substrate 101, and the ink tank 110 are prepared, and then the recording element substrate 103 and the electric wiring substrate 101 are bonded to the ink tank 110. As illustrated in FIG. 5, a first sealant 125 having relatively low viscosity is applied, through a needle 122, which is attached to the tip of a syringe 122, to the space between the first side surface 118*a* and the corresponding sidewall 119 of the depression 111 and flow sufficiently to fill the space. At this time, the ink tank 110 is tilted such that the first side surface 118*a*, where the first sealant 125 is applied, faces downward. In addition to capillary action, gravity acts upon the first sealant to reliably guide the first sealant 125 into the space between the first side surface 118*a* and the corresponding sidewall 119 of the depression 111. Then, the ink tank 110 is returned to a horizontal position, and a high-viscosity second sealant 126 is applied to the electric connecting part 107. Then, the first and second adhesives and the first and second sealants 125 and 126 are thermally cured at once.

Figure 6:
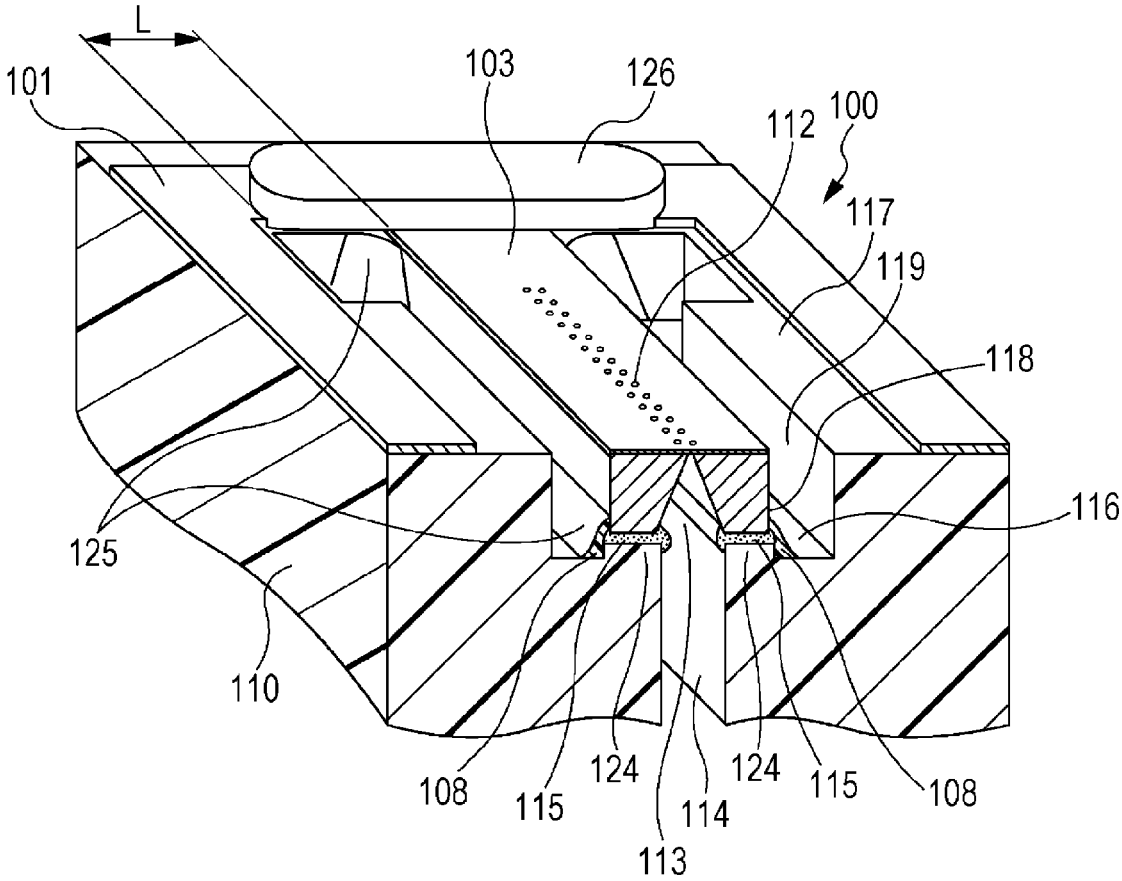
FIG. 6 is a perspective view of the liquid discharge head according to the third embodiment.

FIG. 6 is a perspective view of the liquid discharge head 100 produced through such a process. The first sealant 125 filling the space between the first side surface 118*a* and the corresponding sidewall 119 of the depression 111 is thermally cured after application, together with the first and second adhesives. The viscosity of the first sealant 125 decreases temporarily before curing. Since the ink tank 110 is returned to a horizontal position, a small amount of the first sealant 125 flows along the edge parts 108 defined by the second side surfaces 118*b* and the groove parts 116, reaches the ends, and cures. As a result, the entire length of the surface of the first adhesive 115 exposed between the back surface 106 of the recording element substrate 103 and the ink tank 110 is covered with the first sealant 125. Parts of the bottom surfaces of the groove parts 116 and parts of the second side surfaces 118*b* are not covered with the first sealant 125 and are exposed. The area of the second side surfaces 118*b* covered with the first sealant 125 is desirably smaller than the exposed area of the second side surfaces 118*b*.

Then, porous resin that retains the ink and generates negative pressure is placed inside the ink tank 110; a predetermined amount of ink of the each color is injected to the corresponding ink tank 110; and a covering member is joined to the ink tank 110.

This embodiment achieves the same advantages as those according to the first embodiment.

Fourth Embodiment

Figure 7:
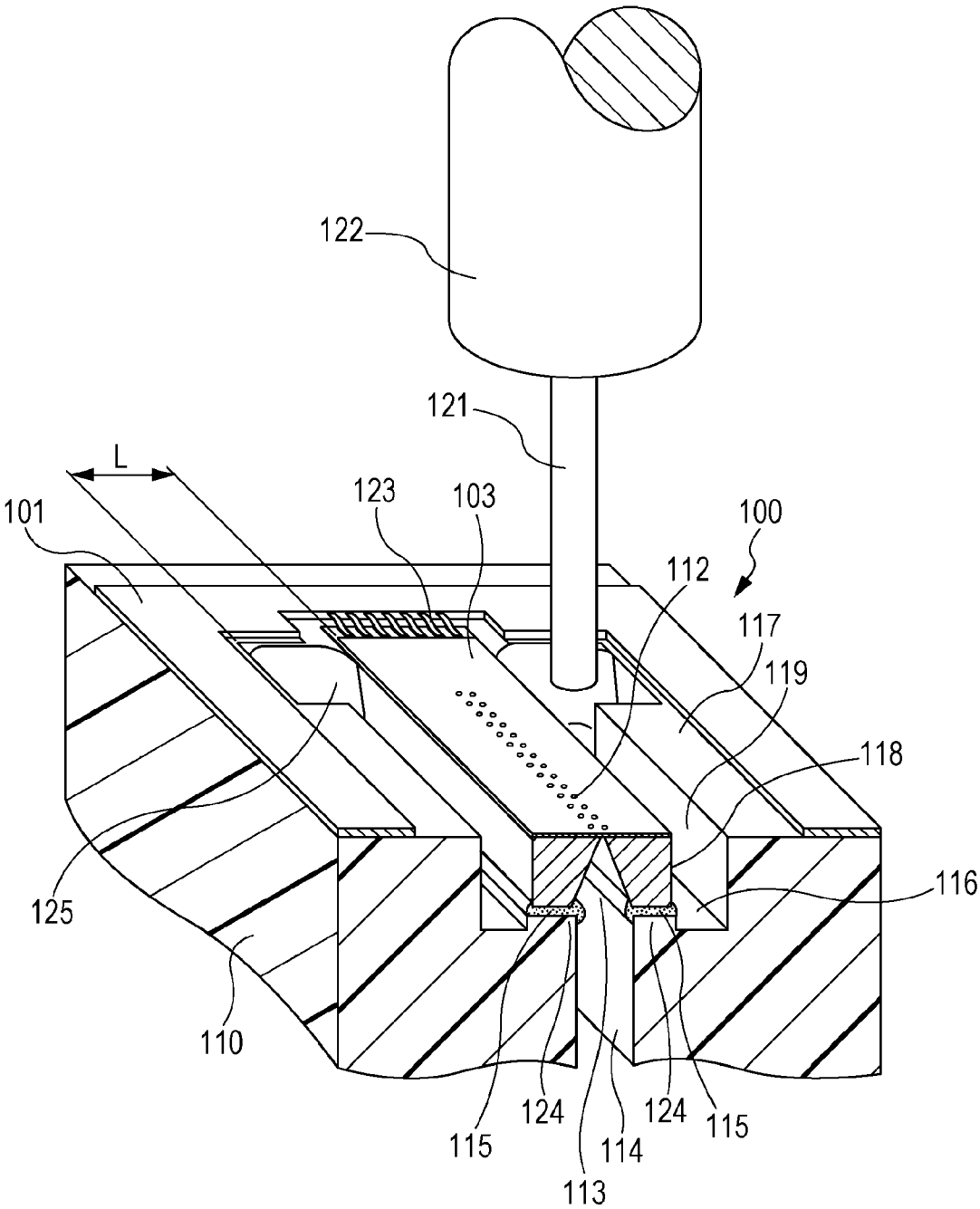
FIG. 7 is illustrates a method of producing a liquid discharge head according to a fourth embodiment.

Similar to FIG. 1, FIG. 7 is a perspective view of a fourth embodiment of the present invention. Members and parts that are the same as those in FIGS. 1 to 6 are represented by the same reference numerals. Except for the method of forming a sealant, the basic configuration and method of producing a liquid discharge head is the same as those according to the first embodiment. A method of producing a liquid discharge head according to this embodiment will be described below.

Similar to the first embodiment, the recording element substrate 103, the electric wiring substrate 101, and the ink tank 110 are prepared, and then the recording element substrate 103 and the electric wiring substrate 101 are bonded to the ink tank 110. Then, as illustrated in FIG. 7, the relatively low-viscosity first sealant 125 is applied from a needle 121, which attached to the tip of a syringe 122, to an area close to the electric connecting part 107. The width of the space between the first side surface 118*a* and the corresponding sidewall 119 of the depression 111 is small, and inner leads 123 are disposed at a pitch of approximately 0.15 mm. Thus, the space is filled with the low-viscosity first sealant 125 by capillary action. The high-viscosity second sealant 126 is applied to the electric connecting part 107, and the first and second adhesives and the first and second sealants 125 and 126 are thermally cured at once.

Figure 8:
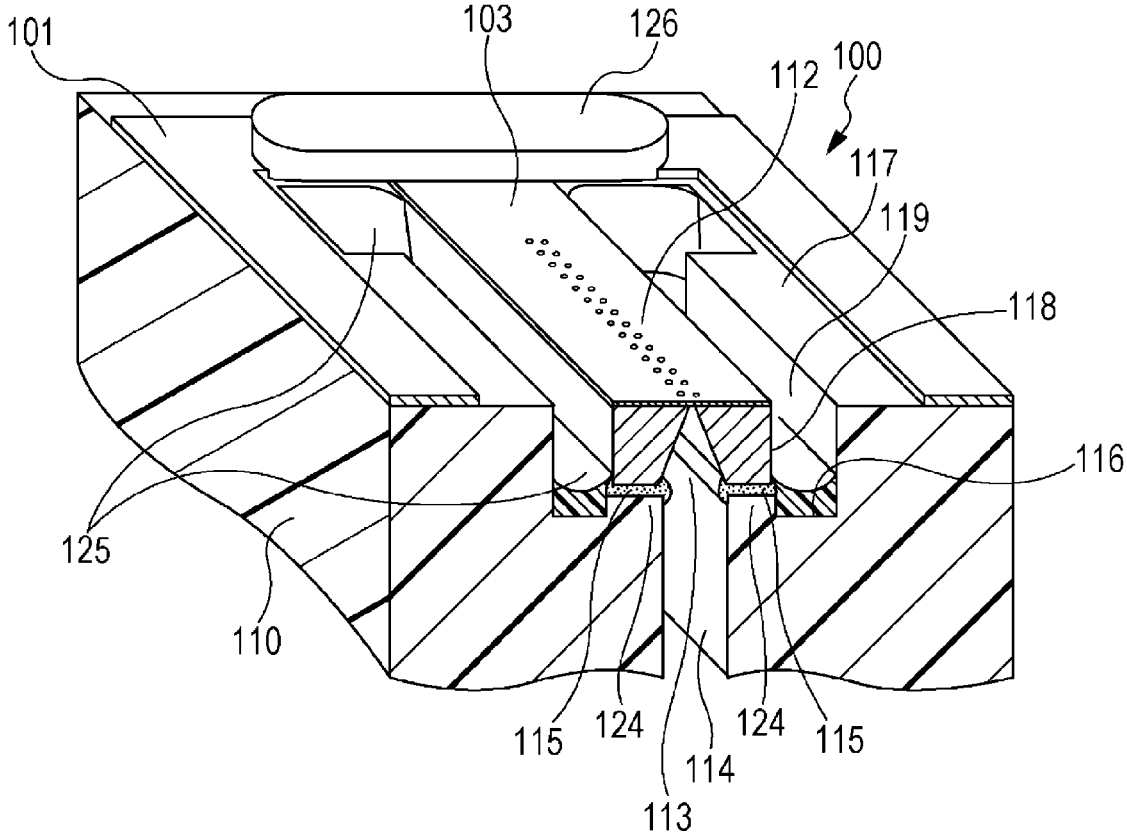
FIG. 8 is a perspective view of the liquid discharge head according to the fourth embodiment.

FIG. 8 is perspective view of the liquid discharge head 100 produced through such a process. The application amount of the first sealant 125 is greater than that in the third embodiment, and the amount that flows out from the area closer to the electric connecting part 107 into the space between the second side surface 118*b* and the corresponding sidewall 119 increases. The groove parts 116 in this space are filled with the first sealant 125, and the first adhesive 115 is covered with the first sealant 125.

Then, porous resin that retains the ink and generates negative pressure is placed inside the ink tank 110; a predetermined amount of ink of the each color is injected to the corresponding ink tank 110; and a covering member is joined to the ink tank 110.

Liquid discharge heads were produced using different amounts of the first sealant 125, and thermal shock tests were conducted. The thermal shock tests were conducted under conditions that were harsher than normal (i.e., 200 cycles of temperature change were repeatedly performed, where in each cycle the temperature was changed from 0° C. to 100° C. and back to 0° C. in a cycle (one hour)) so that the effect of the amount of the first sealant 125 could be clearly observed. The ratio of the number of samples not satisfying the electric performance required as a liquid discharge head to the total number of liquid discharge heads tested for thermal shock was determined. The results are listed in Table 1.

TABLE 1

| (Height of first sealant)/(height of side surface of recording element substrate) | Results of thermal shock test |
|---|---|
| 1 | Δ |
| 0.7 | Δ |
| 0.5 | ○ |
| 0.2 | ○ |
| 0 | ○ |

The ratio of the height of the first sealant 125 to the height of the second side surface 118*b* of the recording element substrate 103 was the average value of the length of the side surface of the recording element substrate 103. This is the same as the area ratio of the area of the second side surface 118*b* of the recording element substrate 103 that is covered with the first sealant. When the height of the first sealant 125 exceeded half of the height of the second side surface 118*b*, the percentage of the liquid discharge heads that do not satisfy the electric performance reached approximately 2% (Δ in Table 1). Accordingly, it is desirable that the area of the second side surface 118*b* covered with the first sealant 125 is smaller than the exposed area.

This embodiment also achieves the same advantages as those according to the first and third embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-052979 filed Mar. 10, 2011, which is hereby incorporated by reference herein in its entirety.

What is claimed is:

1. A liquid discharge head comprising:

a recording element substrate having a discharge-port surface having a discharge port discharging a liquid, side surfaces on sides of the discharge-port surface, and a back surface of the discharge-port surface having an opening of an ink supplying port supplying ink to the discharge port;

a supporting member having a depression accommodating the recording element substrate, the depression including a supporting part disposed at a bottom surface of the depression and supporting the recording element substrate with an adhesive and an opening of an ink channel communicating with the ink supplying port; and an electric wiring substrate disposed on a surface of the supporting member having the depression and having an electric connecting part connecting with a side of the discharge-port surface of the recording element substrate, wherein the side surfaces of the recording element substrate includes a first side surface on a side of the discharge-port surface having the electric connecting part and a second side surface on a side of the discharge-port surface not having the electric connecting part, wherein the bottom surface of the depression has a groove part extending along the second side surface between the supporting part and a sidewall of the depression, and wherein a space between the first side surface and the sidewall of the depression is sealed together with the electric connecting part with a sealant, at least a part of the second side surface is exposed and not covered with the sealant, and at least part of a surface of the adhesive facing the sidewall of the depression is sealed with the sealant.

2. The liquid discharge head according to claim 1, wherein part of the bottom surface of the groove part is exposed and not covered with the sealant.

3. The liquid discharge head according to claim 1, wherein the supporting member is composed of thermoplastic resin, the sealant and the adhesive is composed of thermal-curable resin, and the softening temperature of the supporting member is higher than curing temperatures of the sealant and the adhesive.

4. The liquid discharge head according to claim 1, wherein the adhesive is composed of photo-curable resin.

5. The liquid discharge head according to claim 1, wherein an area of the second side surface covered with the sealant is smaller than an area of the exposed part of the second side surface.

* * * * *